US010543465B2

(12) United States Patent
Lekner et al.

(10) Patent No.: US 10,543,465 B2
(45) Date of Patent: Jan. 28, 2020

(54) ROTARY SHAFT FOR PROCESSING FOODSTUFFS, INDUSTRIAL DEVICE COMPRISING SUCH A ROTARY SHAFT, A METHOD OF MANUFACTURING SUCH A ROTARY SHAFT AND A METHOD FOR PROCESSING FOODSTUFFS

(71) Applicant: Innolek Beheer B.V., Eijsden (NL)

(72) Inventors: Gilis Anne-Marie Victor Lekner, Berg en Terblijt (NL); Julian Wilhelmus Maria Lekner, Berg en Terblijt (NL); Geneviève Maria Michaela Lekner, Berg en Terblijt (NL)

(73) Assignee: Innolek Beheer B.V., Eijsden (NL)

( * ) Notice: Subject to any disclaimer, the term of this patent is extended or adjusted under 35 U.S.C. 154(b) by 44 days.

(21) Appl. No.: 15/531,133

(22) PCT Filed: Nov. 18, 2015

(86) PCT No.: PCT/EP2015/076995
§ 371 (c)(1),
(2) Date: May 26, 2017

(87) PCT Pub. No.: WO2016/083214
PCT Pub. Date: Jun. 2, 2016

(65) Prior Publication Data

US 2018/0008942 A1 Jan. 11, 2018

(30) Foreign Application Priority Data

Nov. 26, 2014 (NL) ..... 1041069

(51) Int. Cl.
*B01F 7/00* (2006.01)
*B01F 7/08* (2006.01)

(52) U.S. Cl.
CPC ..... *B01F 7/00433* (2013.01); *B01F 7/00116* (2013.01); *B01F 7/00175* (2013.01);
(Continued)

(58) Field of Classification Search
CPC ..... B01F 7/00433; B01F 7/00116; B01F 7/00175; B01F 7/082; B01F 7/085;
(Continued)

(56) References Cited

U.S. PATENT DOCUMENTS 1,978,490 A 10/1934 Eggert
3,145,017 A * 8/1964 Thomas ..... A23G 9/16 366/310

(Continued)

FOREIGN PATENT DOCUMENTS

DE 2145900 B1 11/1972
DE 2942325 A1 4/1981

(Continued)

OTHER PUBLICATIONS

PCT International Search Report, PCT/EP2015/076995, dated Feb. 11, 2016.

(Continued)

*Primary Examiner* — Anshu Bhatia
(74) *Attorney, Agent, or Firm* — TraskBritt

(57) ABSTRACT

The invention relates to a rotary shaft (23) for processing foodstuffs, wherein the rotary shaft (23) has a rotation axis and the rotary shaft comprises at least one tool (11). The at least one tool (11) extends along the rotation axis. The tool (11) further has an airfoil profile such that the tool comprises a leading edge, a trailing edge, an upper surface and a lower surface, wherein the leading edge and the trailing edge are different.

17 Claims, 8 Drawing Sheets

Figures 1A, 1B:
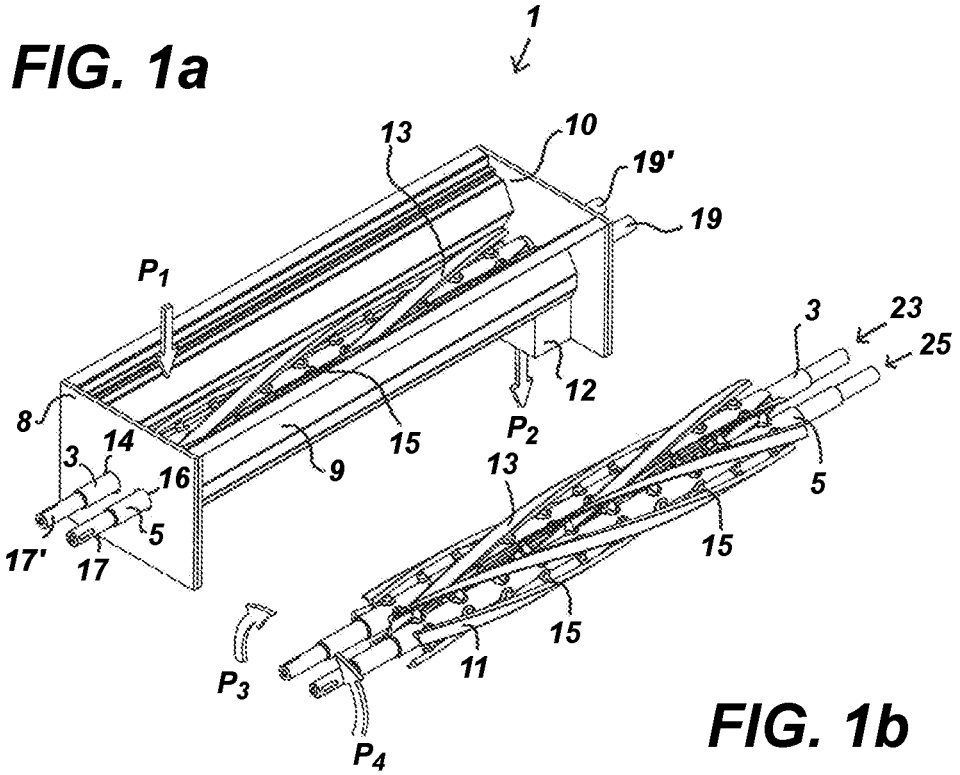

(52) U.S. Cl.
CPC ..... *B01F 7/082* (2013.01); *B01F 7/085* (2013.01); *B01F 2215/0011* (2013.01); *B01F 2215/0014* (2013.01); *B01F 2215/0019* (2013.01)

(58) Field of Classification Search
CPC ..... B01F 2215/0011; B01F 2215/0014; B01F 2215/0019
See application file for complete search history.

(56) References Cited

U.S. PATENT DOCUMENTS

| | | | | |
|---|---|---|---|---|
| 3,182,633 | A * | 5/1965 | Lodige ..... | B01F 7/048 118/417 |
| 4,600,313 | A | 7/1986 | Moroo et al. | |
| 7,914,200 | B1 * | 3/2011 | Hockmeyer ..... | B01F 7/00208 165/94 |
| 2004/0098960 | A1 * | 5/2004 | Csonka ..... | A01D 34/73 56/295 |
| 2010/0233919 | A1 | 9/2010 | Ersoy | |
| 2012/0024996 | A1 * | 2/2012 | Bongratz ..... | B01F 7/00133 241/101.5 |

FOREIGN PATENT DOCUMENTS

| | | | |
|---|---|---|---|
| DE | 3603155 | A1 | 8/1987 |
| DE | 3844440 | C1 | 3/1990 |
| EP | 0075049 | | 9/1981 |
| EP | 222599 | A2 | 4/1991 |
| EP | 816937 | A2 | 10/2003 |
| WO | WO2006135229 | A2 | 12/2006 |
| WO | 2015076995 | A1 | 5/2015 |
| WO | 2016083214 | A1 | 6/2016 |

OTHER PUBLICATIONS

PCT International Written Opinion, PCT/EP2015/076995, dated Feb. 11, 2016.

* cited by examiner

B-B (1:2)

A-A (1:2)

B-B (1:2)

A-A (1:2)

ROTARY SHAFT FOR PROCESSING FOODSTUFFS, INDUSTRIAL DEVICE COMPRISING SUCH A ROTARY SHAFT, A METHOD OF MANUFACTURING SUCH A ROTARY SHAFT AND A METHOD FOR PROCESSING FOODSTUFFS

CROSS-REFERENCE TO RELATED APPLICATIONS

This application is a national phase entry under 35 U.S.C. § 371 of International Patent Application PCT/EP2015/076995, filed Nov. 18, 2015, designating the United States of America and published in English as International Patent Publication WO 2016/083214 A1 on Jun. 2, 2016, which claims the benefit under Article 8 of the Patent Cooperation Treaty to Netherlands Patent Application Serial No. 1041069, filed Nov. 26, 2014.

The invention relates to a rotary shaft for processing foodstuffs and a method of manufacturing such a rotary shaft. The invention also relates to an industrial device for processing foodstuffs and a method for processing foodstuffs using the industrial device.

An example of a rotary shaft, an industrial device and a method for mixing and/or kneading foodstuffs using the industrial device are generally known from WO2006/135229. In the known device the bar-shaped tool is connected to a central shaft part by a number of spacers.

It is a goal of the present invention to provide a rotary shaft having a tool designed for an improved and more energy efficient processing of food products, in particular mixing, kneading and/or conching foodstuffs.

This goal is achieved by a rotary shaft according to claim 1.

The rotary shaft for processing foodstuffs, in particular kneading and/or mixing and/or conching foodstuff, has a rotation axis. The rotation axis extends in the longitudinal direction of the rotary shaft. The rotary shaft comprises at least one tool which extends along the rotation axis. The tool has an airfoil profile such that the tool comprises a leading edge, a trailing edge, an upper surface and a lower surface, wherein the leading edge and the trailing edge are different. The leading edge and the trailing edge are different to increase the shear stress in the foodstuff being processed by the rotary shaft. This rotary shaft allows improved mixing, kneading and/or conching of foodstuffs with considerably less power than most other types of known tools, i.e. the airfoil profile design of the tool contributes to efficient foodstuff processing. Another advantage of the trailing edge and leading edge of the tool being different is that in use in a container between a tool and the container wall the foodstuffs can be subjected to more shear stress, as a result of which the foodstuff such as for example dough will be better kneaded and for example chocolate will be better couched in particular in the pasty phase. Such relatively high shear stress requires normally much power required to turn the shafts, which power consumption is drastically decreased with the rotary shaft of the present invention.

A reference line often used in discussing an airfoil is the chord line, a straight line drawn through the profile connecting the extremities of the leading and trailing edges. The distance from this chord line to the upper and lower surfaces of the wing/airfoil profile denotes the magnitude of the upper and lower camber at any point. The term camber refers to the curvature of the upper surface and lower surface of a wing/airfoil profile. The upper surface and the lower surface of the tool may have a non-symmetrical curvature to optimize the lift effect. In such a design a camber of the upper surface of the tool can be more pronounced than a camber of the lower surface, which can be relatively flat. Another reference line, drawn from the leading edge to the trailing edge, is the mean camber line. This mean line is equidistant at all points from the upper and lower surfaces. In an optimal airfoil design of the tool the mean camber line is located above the chord line. In addition, the maximum thickness of the airfoil profile is preferably located closer to the leading edge than the trailing edge.

The chord length is the length of the chordline from leading edge to trailing edge and is the characteristic longitudinal dimension of an airfoil, wherein the longitudinal dimension of the airfoil profile of the tool extends in a transverse plane to the longitudinal direction of the rotary shaft. The longitudinal direction of the rotary shaft extends parallel to the rotation axis. In one aspect, the tool may have an airfoil profile having a chord length being at least ⅓ of the minimal distance between the rotation axis and the tool.

The rotation axis is a virtual rotation axis. The rotary shaft may comprise two opposing shaft elements having a distance between them. The at least one tool may extend between two opposing ends of the two shaft elements over the distance between the opposing shaft elements, i.e. the rotary shaft may be at least partly constructed without a physical center element seen in the longitudinal direction of the rotary shaft. The length of the tool measured in the longitudinal direction is at least 50% of the length of the rotary shaft. The rotary shaft may comprise more than one tool, wherein the tools are connected to each other by at least one spacer, preferably by a number of spacers.

The rotary shaft may also comprise a central shaft part and the at least one tool is connected to the central shaft part by at least one spacer, preferably a number of spacers. The virtual rotation axis of the rotary shaft is located in the central shaft part, preferably coincides with the center of the central shaft part.

Advantageously the central shaft part, the at least one spacer and the at least one tool are produced in one-piece, preferably by using electrical discharge machining.

It is also an object of the present invention to provide an industrial device designed for an improved and more energy efficient processing foodstuffs, in particular mixing, kneading and/or conching foodstuffs. This object is achieved with the industrial device comprising at least one container having the above described rotary shaft, wherein the at least one rotary shaft extends in the longitudinal direction of the container. The industrial device for processing foodstuffs, may also comprises a container having at least two counter-rotating rotary shafts, wherein the rotary shafts extend in the longitudinal direction of the container. In one aspect, the device may be configured for processing foodstuffs in a continuous matter. In another aspect, the at least one tool may be shaped and/or orientated such that the distance between the upper surface and a virtual cylinder having a center coincident with the rotation axis of the rotary shaft varies, preferably the radius of the virtual cylinder is larger than the maximum distance between the rotation axis of the rotary shaft and the upper surface, wherein the distance between the upper surface and the virtual cylinder is smaller near the trailing edge than near the leading edge. With such an advantageous design, it is possible to increase the pressure between a tool and the container wall such that the foodstuffs can be subjected to more shear stress.

In a further aspect, the container of the device contains irregularities in the inner container wall, for example corners, such that the foodstuff processed by means of the rotary shaft experiences periodically more friction by means of the irregularity in the container wall than a cylindrical, or a partly cylindrical (for example oval like) container wall.

The invention will now be explained in more detail with reference to the drawings by means of a description of an exemplary embodiment of a rotary shaft and an exemplary embodiment of an industrial device for processing foodstuffs, wherein:

FIGS. 1*a,b* show a perspective view of an industrial device for processing foodstuffs and respectively a perspective view of two rotary shafts used in the industrial device shown in FIG. 1*a;*

Figure 2A:
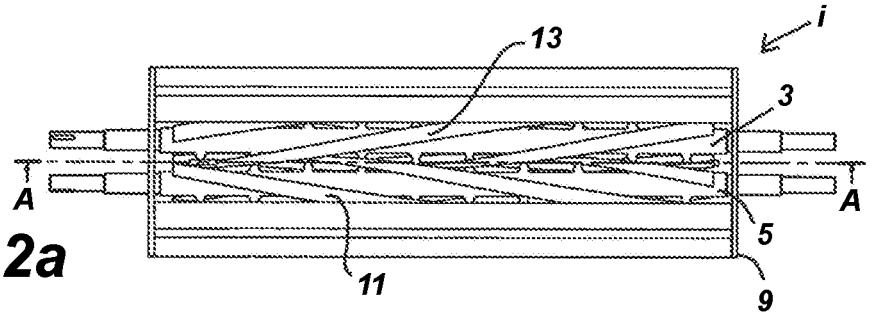
Figure 2B:
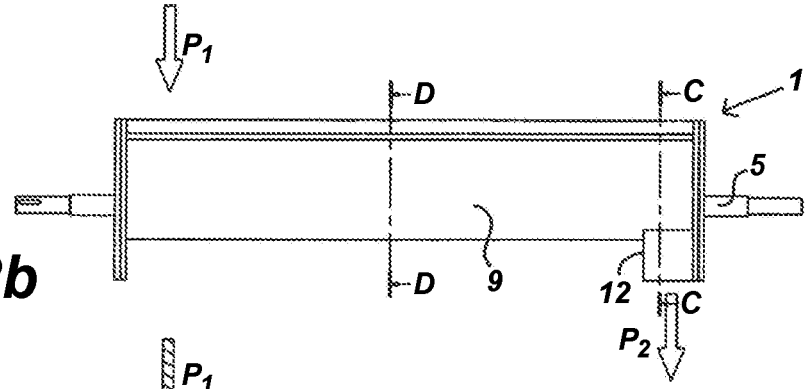
Figure 2C:
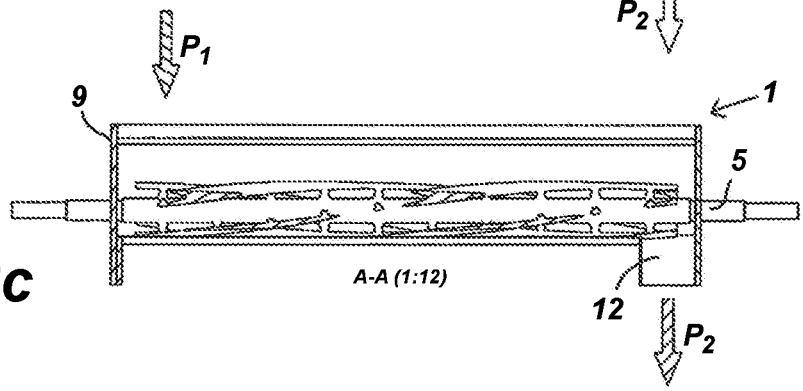
Figure 2D:
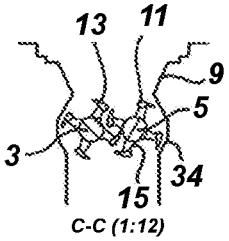
Figure 2E:
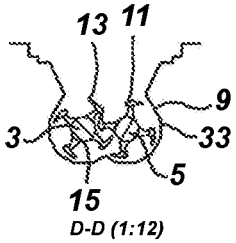
Figure 3A:
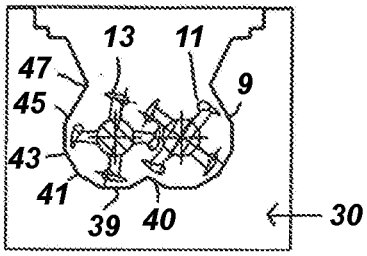
Figure 3B:
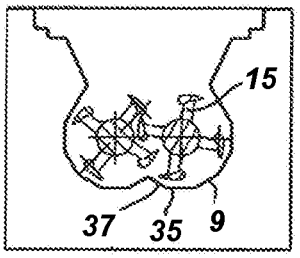
Figure 3C:
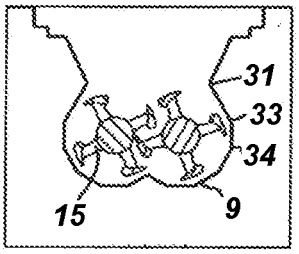
Figure 3D:
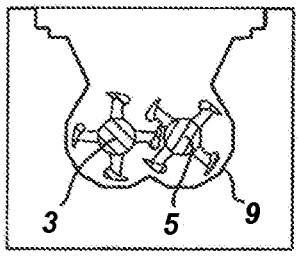
Figure 6A:
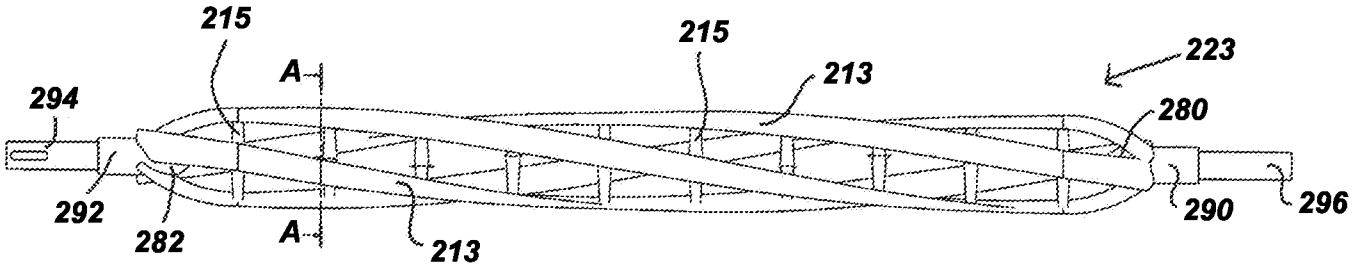
Figure 6B:
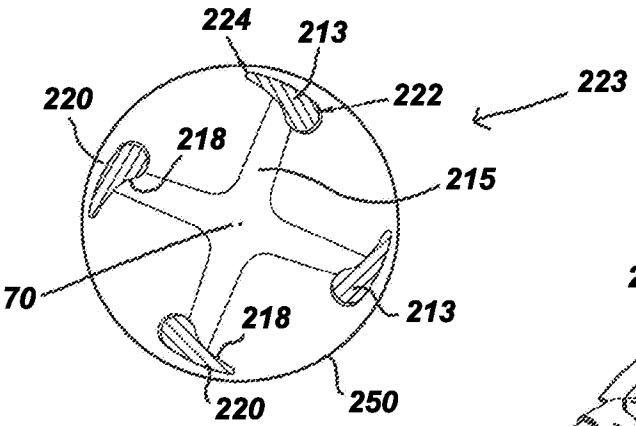
Figure 6C:
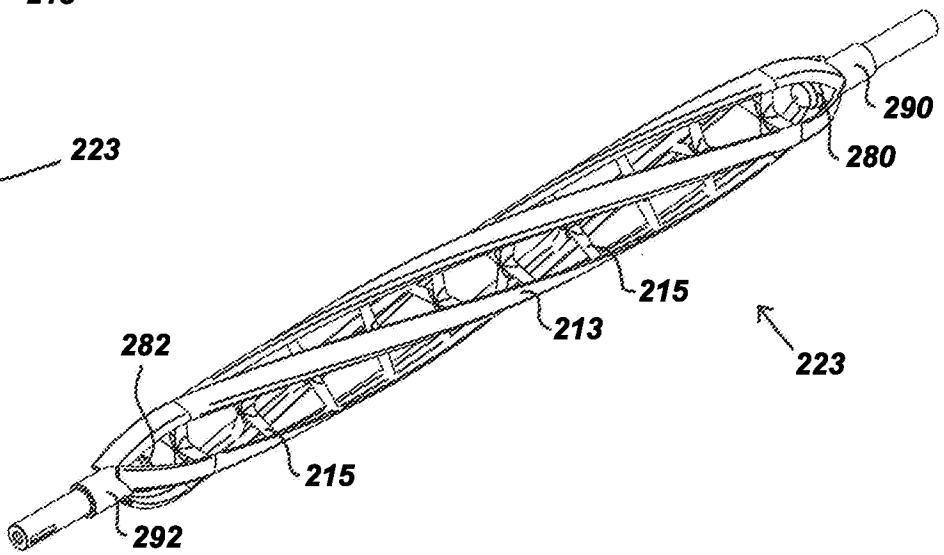

FIGS. 2*a-e* are various views of the industrial device for processing foodstuffs as shown in FIG. 1;

FIGS. 3*a-d* are sections of the industrial device as shown in FIG. 2*e*, wherein the counter-rotating rotary shafts are shown in various positions to each other;

FIGS. 4*a-d* show various views of a first embodiment of a rotary shaft;

FIGS. 5*a-d* show various views of a second embodiment of a rotary shaft;

FIGS. 6*a-c* show various views of a third embodiment of a rotary shaft.

In the following description identical or corresponding parts have identical or corresponding reference numerals.

FIG. 1*a* shows in perspective view an industrial device 1 by means of which food products, such as foodstuffs in particular dough-like products such as bread dough or pastry or chocolate can be mixed and/or kneaded and/or couched. The industrial device 1 comprises a container having a container wall 9. The structure of such an industrial device 1 is known per se to the skilled person, for example from WO2006135229, and consequently only a compact description will be given herein. FIG. 1*b* shows in perspective view two counter-rotating rotary shafts 23, 25 which extend in the longitudinal direction of the container.

Each of the two counter-rotating rotary shafts 23, 25 disposed inside the container comprises a central shaft part 3, 5 and tools 11, 13 for mixing, conching and/or kneading foodstuffs, as will be explained in more detail hereafter. The two counter-rotating rotary shafts 23, 25 can be rotatably driven via driving means (not shown) in a manner which is known per se. The device 1 comprises a container inlet at an upstream location and indicated by arrow P1, via which the products to be processed can be introduced into the interior of the container. Downstream thereof, the container is provided with a container outlet 12, via which the processed product as indicated by arrow P2 leaves the device 1 again. The inlet of the container is located closer to a first end 17, 17' of the rotary shaft 23, 25 than to a second end 19, 19' of the rotary shaft 23, 25 and the outlet 12 is located closer to the second end 19, 19' of the rotary shaft 23, 25 than to the first end 17, 17' of the rotary shaft 23, 25. The distance between the inlet and the outlet 12 is at least 50 cm, preferably at least 1 meter. Hence, in the container the foodstuff main transport direction extends parallel to the rotary shafts 23, 25.

In use the rotary shafts 23, 25 counter-rotate in the directions indicated by P3 and P4. Mounted on each central shaft part 3, 5 of the rotary shafts 23, 25 are four tools 11, 13. Each tool 11, 111 is a wing having an airfoil profile having a trailing edge and a leading edge. The two counter-rotating rotary shafts are identical, wherein the rotary shafts rotate in a direction such that the leading edge is the front edge and the trailing edge is the back edge. The tools 11, 13 are connected to the central shaft parts 3, 5 by bar-like spacers 15 and the tools 11, 13 helically surround the central shaft parts 3, 5. The spacers 15 extend transversely to the longitudinal direction of the central shaft parts 3, 5. The function of the helical configuration of the tools 11, 13 along the central shaft parts 3, 5 is to transport the foodstuff horizontally between the inlet and the outlet 12.

The operative space of the container, i.e. the area where the product is being processed is formed by a circumferential wall 9 of the container around the tools of the rotary shafts 23, 25 and end plates 8, 10 of the container. The end plates 8, 10 comprise through-holes 14, 16 through which the ends of the central shaft parts 3, 5 extend.

FIGS. 2*a-e* and 3*a-d* show the device 1 of FIG. 1 in various views. FIGS. 2*d*, 2*e* and 3*a-d* show sectional views of the device 1 along the lines C-C and D-D in FIG. 2*b*. In the container of the industrial device 1, the identical rotary shafts are further orientated under a different angle with respect to each other such that the tools 11, 13 of the two rotary shafts 23, 25 rotate freely in overlapping virtual rotating circles. The container comprises irregularities in the inner container wall 9, the irregularities of the container shown are corners 31, 33, 34, 35, 37, 39, 40, 41, 43, 45, 47 in the lower part 30 of the container wall 9. These corners are located near the two overlapping virtual rotating circles. In use the foodstuffs processed by means of the rotary shafts 23, 25 experience periodically more friction by means of the corners in the container wall which prevents foodstuffs sticking to the inner container wall such that the kneading and/or conching quality can be enhanced. As can be seen in the FIGS. 2*d*, 2*e* and 3*a-d*, the spacer 15 is a bar-like element which is connected to a part of the lower surface 18 (FIGS. 4*c*,d and 5*c,d*) of the tool closer to a leading edge 22, 122 than to a trailing edge 24, 124. The spacers 15 are somewhat tapered, because the spacers have a larger cross-section near the central shaft part 3, 5 than near the tool 11, 13. The spacers 15 have been regularly spaced with respect to each other over the surface of the central shaft part 5 in the circumferential direction and the longitudinal direction in helix configurations to support the tools helically surrounding the central shaft part.

The central shaft part 3, 5, the spacers 15 and the tools of a single rotary shaft 23, 25 are produced in one-piece, preferably by using electrical discharge machining.

FIGS. 4*a-d* show the rotary shaft 25 also shown in FIGS. 1-3. The device 1 comprising this rotary shaft 25 is configured for continuously processing foodstuffs from the inlet to the outlet 12 of the container. The helically configuration of the tool 11 provides a horizontal transport function in the container between the inlet and the outlet.

FIGS. 5*a-d* show another embodiment of a rotary shaft 125. In this embodiment of the rotary shaft 125, the tool 111 extends parallel to the longitudinal direction of the rotary shaft 125 and the spacers 115 have been regularly spaced with respect to each other in the circumferential direction and the longitudinal direction in a straight-line configuration over the surface of the cylindrical central shaft part 105. This embodiment of the rotary shaft 125 can be used in an industrial device (not shown) wherein the foodstuffs being processed are mainly vertically displaced through the container (not shown), i.e. the rotary shaft 125 comprising the tools 111 extending parallel to the center of the rotary shaft has almost no horizontal transport function. In such a container the inlet and the outlet at least partly overlap each other or the inlet and the outlet are concentric. In such an industrial device the foodstuffs will vertically displace through the container between the inlet and the outlet under the influence of gravity.

FIGS. 6*a-c* show another embodiment of a rotary shaft 223. In this embodiment of the rotary shaft 223, the tool 213 helically extends along a virtual center 70 of the rotary shaft 223 in a manner similar to the tools 11, 13 of the rotary shaft 23, 25 shown in FIGS. 1-4*d*. With respect to the rotary shaft 23, 25, the rotary shaft 223 does not have a central shaft part. The rotary shaft 223 comprises two opposing shaft elements 290, 292 having a distance there between. The four tools 213 extend between two opposing ends 280, 282 of two shaft elements 290, 292 over the distance between the two opposing shaft elements 290, 292. These opposing shaft elements 290, 292 comprise couplings 294, 296 for coupling the rotary shaft with for example a driving unit (not shown) and a bearing unit (not shown). The four tools 213 are connected to each other by a number of X-shaped spacers 225. The rotary shaft 125 can be used in an industrial device 1. It is also possible that the spacers for connecting the tools 213 have a different shape. The rotary shaft 125 increases advantageously the volume available for mixing, kneading and/or conching foodstuffs in a container of the industrial device 1, because the rotary shaft 125 has no central shaft part in the operative space of the container, i.e. the rotary shaft 125 occupies less volume in the container and has a relatively low weight.

Figure 4A:
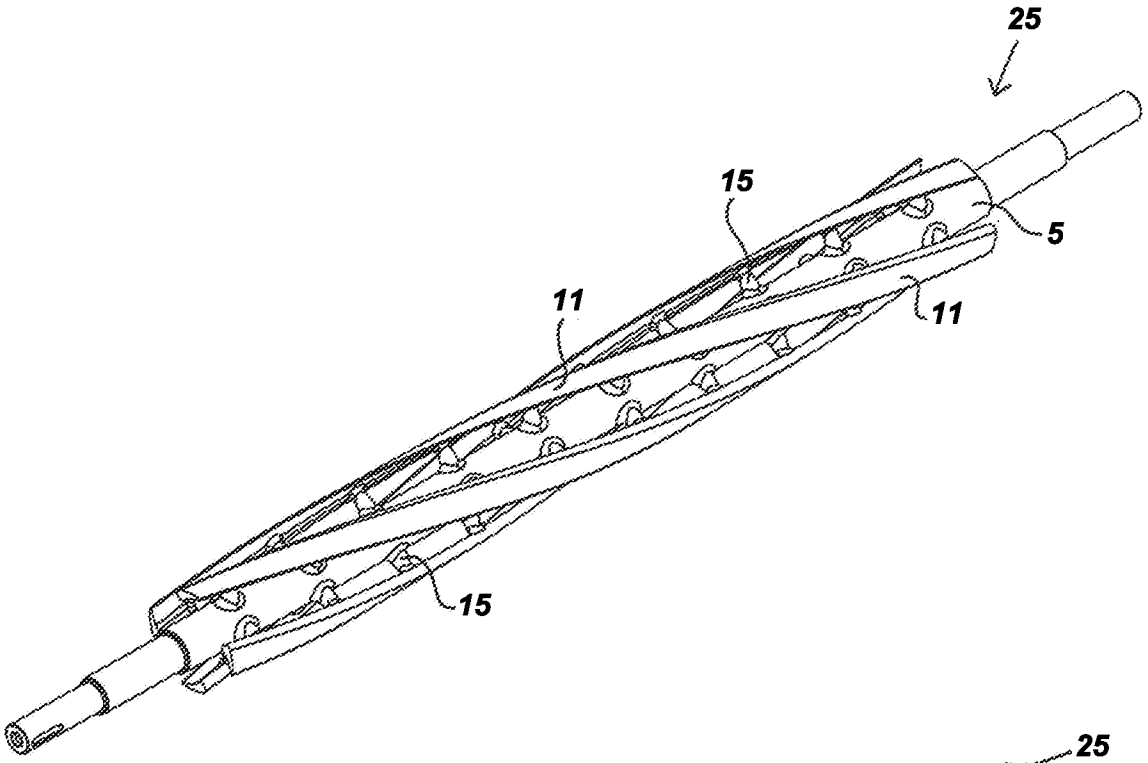
Figure 4B:
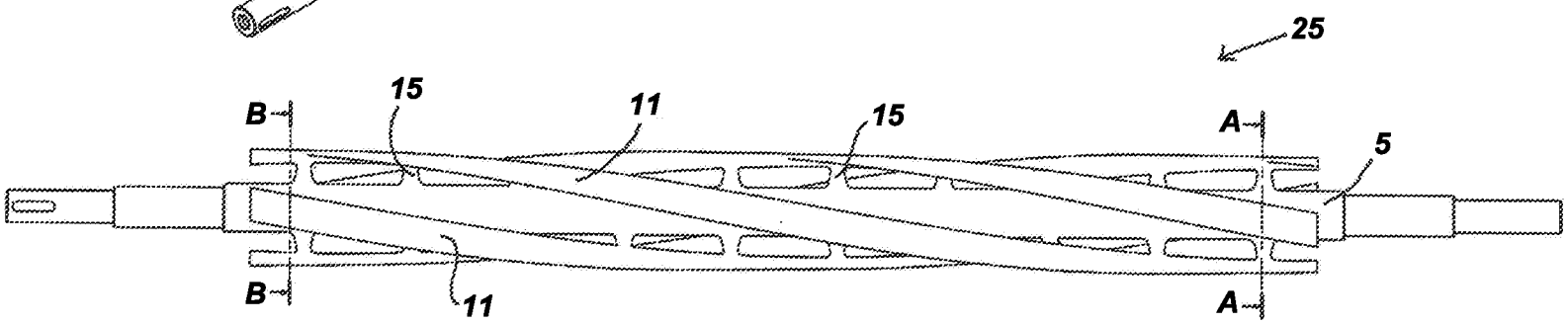
Figure 4C:
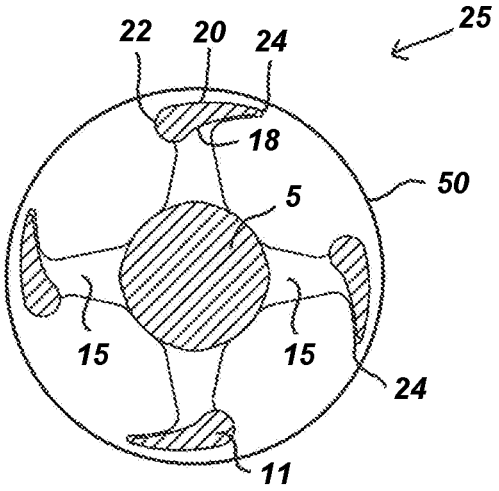
Figure 4D:
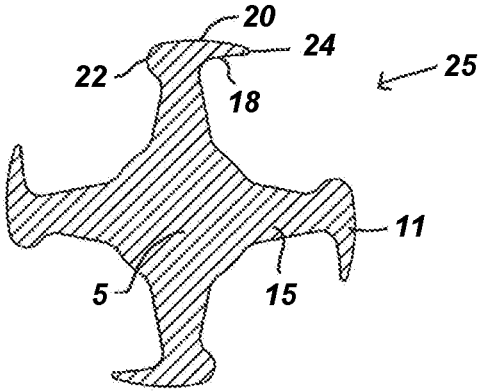
Figure 5A:
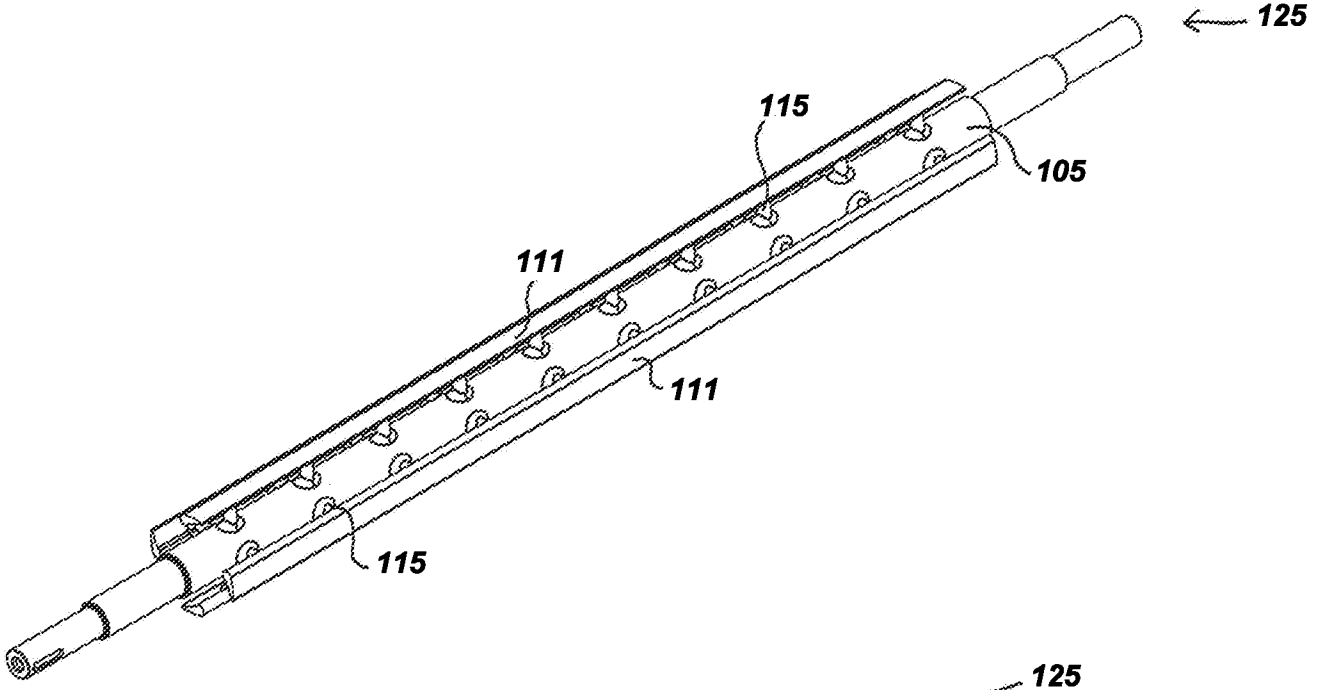
Figure 5B:
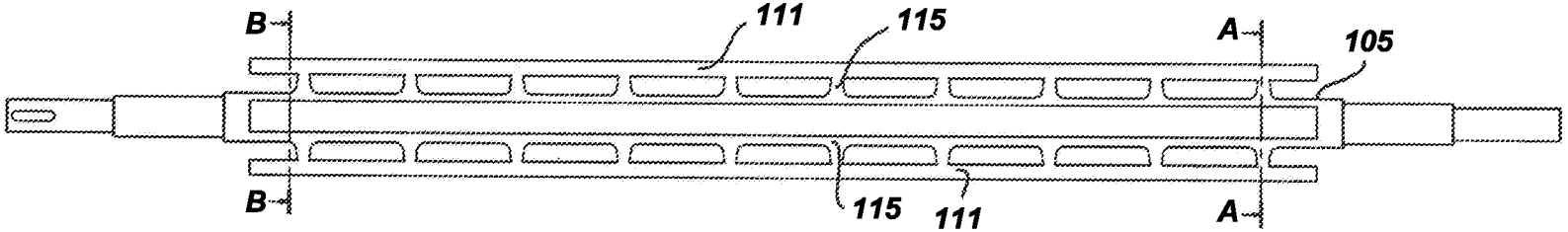
Figure 5C:
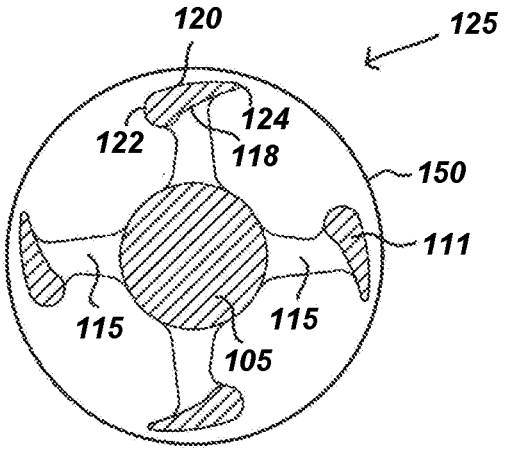
Figure 5D:
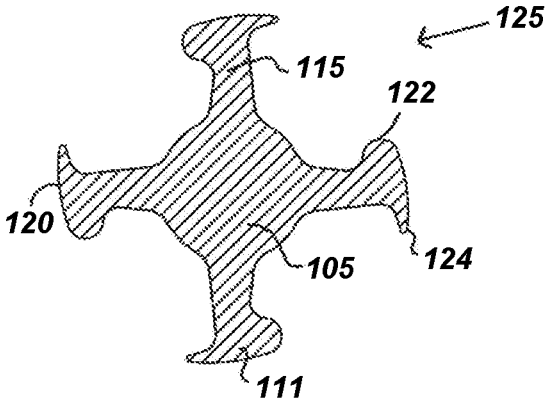

FIGS. 4*c*, d, 5*c*, d and 6*b* show sectional views of the rotary shafts 25; 125; 223 along the lines B-B and A-A in FIGS. 4*b*, 5*b* and 6*b*. These sectional views show that the tools 11, 111, 213 according to the present invention are wings having an airfoil profile such that the tool comprises a leading edge 22, 122, 222 a trailing edge 24, 124, 224, an upper surface 20, 120, 220 and a lower surface 18, 118, 220. In the rotary shaft 25, 125, 223 the leading edge 22, 122, 222 and the trailing edge are different, i.e. the leading edge is shaped differently than the trailing edge 24, 124, 224.

The upper surface 20, 120, 220 and the lower surface 18, 118, 218 of the tool 11, 111, 213 have a nonsymmetrical curvature to optimize the lift effect such that in use in the container of the industrial device 1 the dough or chocolate can be subjected to more shear stress between each tool 11, 111, 213 and the container wall 9, as a result of which the dough will be better kneaded and chocolate will be better couched in particular in the pasty phase. Such relatively high shear stress requires normally much power required to turn the shafts, which power consumption is drastically decreased with the rotary shaft of the present invention, in particular the wing-shaped tool. Without wishing to be bound to any particular theory, it is believed that the airfoil design of the tool 11, 111, 213 achieves in an energy efficient manner a beneficial lift effect on the foodstuff to be processed which in use provides the relatively high shear stress between the upper surface 20, 120, 220 of the tool 11, 111, 213 and the container wall 9, wherein the trailing edge 24, 124, 224 optimizes the flow of the processed foodstuff such that power usage can be reduced. In addition, the wing or airfoil designed tool 11, 111, 213 facilitates to withstand the enormous forces exerted on the rotary shafts 25, 125, 223 such that wear or breakage of the rotary shafts 25, 125, 223 is minimized and maintenance intervals are relatively large.

The camber of the upper surface 20, 120, 220 of the tool 11, 111, 213 can be more pronounced than a camber 18, 118, 218 of the lower surface, which can be relatively flat. The tools 11, 111, 213 are shaped and/or orientated such that the distance between the upper surface 20, 120, 220 and a virtual cylinder 50, 150, 250 varies. The virtual cylinder 50, 150, 250 has a center coincident with the rotation axis 70 of the rotary shaft 25, 125 and the radius of the virtual cylinder 50, 150, 250 is larger than the maximum distance between the rotation axis 70 of the rotary shaft 25, 125, 223 and the upper surface 20, 120, 220. The distance between the upper surface 20, 120, 220 and the virtual cylinder 50, 150, 250 is smaller near the trailing edge 24, 124, 224 than near the leading edge 22, 122, 222.

Another reference line, drawn from the leading edge to the trailing edge, is the mean camber line, which in the airfoil design of the tool 11, 111, 213 is located above the chord line. The maximum thickness of the airfoil profile is preferably 1.0-10.0 centimeter and the maximum thickness of the airfoil profile is located closer to the leading edge than the trailing edge. The leading edge 22, 122, 222 and the trailing edge 24, 124, 224 are round, wherein the radius of the leading edge 22, 122, 224 is larger than the radius of the trailing edge 24, 124, 224, i.e. the radius of the leading edge 22, 122, 224 is preferably 3-10 times larger than the radius of the trailing edge 24, 124. For example, the radius of the trailing edge 24, 124, 224 is approximately 2.5 mm and the radius of the leading edge 22, 122, 224 is approximately 12.5 mm.

The chord length is the length of the chordline from leading edge to trailing edge and is the characteristic longitudinal dimension of an airfoil, wherein the longitudinal dimension of the airfoil profile of the tool extends in a transverse plane to the longitudinal direction of the rotary shaft. The tool 11, 111, 213 has an airfoil profile having a chord length being at least the radius of the central shaft part 5, 105, wherein the radius of the central shaft part 5, 105 is preferably at least 4.0 cm.

The shortest distance between the rotation axis of the central shaft part 5, 105 and the at least one tool 11, 111 is preferably 1.5-5.0 times the radius of the central shaft part.

In the embodiments shown each tool 11, 111, 213 extends along the virtual rotation axis of the rotary shaft, i.e. the shown tools extend over more than ⅔ of the length of the rotary shaft. The tools minimally extend over more than 50% of the length of the rotary shaft.

It is possible that at least one tool (not shown) has different airfoil profiles in the longitudinal direction of the rotary shaft to provide different foodstuff processing zones in the longitudinal direction of the shaft. In this way it is possible to adapt the tool to changes in the foodstuff being processes to provide an optimal mixing, kneading and/or conching operation in each zone.

Further, it is possible that each tool (not shown) is connected to the central shaft by means of a single spacer. A tool (not shown) may comprise a number of tool parts on the central shaft part, wherein the tool parts are spaced in the longitudinal direction of the rotary shaft. Each tool part only covers a minimal length of the rotary shaft, for example each tool part only covers 20% of the length of the rotary. Again, the tool as a whole, i.e. all the tool parts of a single tool, extends over at least 50% of the length of the rotary shaft. The longitudinally over the length of the rotary shaft spaced tools may have a helical pattern, such as the longitudinally and helically extending tools 11, 13, 213 or may have the straight line pattern such as the longitudinally extending tools 111.

In another embodiment the tools (not shown) may have a round leading edge with a circular or oval cross-section and a sharp trailing edge, i.e. the trailing edge may be a sharp edge, e.g. the upper surface and the lower surface define a triangle in cross-section wherein a corner of the triangle defines the sharp edge.

It is also possible that the rotary shaft (not shown) comprises at least one tool having an airfoil profile and at least one tool having another profile. In addition, it is possible that the rotary shaft (not shown) comprises tools having different airfoil profiles.

The skilled person will appreciate that in the foregoing the invention has been described on the basis of a few possible embodiments, which are preferred. The invention is not limited to these embodiments, however. Many possible equivalent modifications are conceivable within the framework of the invention, which modifications may fall within the scope of the appended claims.

The invention claimed is:

1. An industrial device comprising at least one container having at least one rotary shaft for processing foodstuffs, wherein the rotary shaft has a rotation axis and comprises at least one tool that extends along the rotation axis, wherein the tool has an airfoil profile such that the tool comprises a leading edge, a trailing edge, an upper surface, and a lower surface, wherein the at least one tool is shaped and/or oriented such that the distance between the upper surface and a virtual cylinder, having a center coincident with the rotation axis of the rotary shaft and having a radius larger than the maximum distance between the rotation axis of the rotary shaft and the upper surface, varies, and wherein the leading edge and the trailing edge are different in that the distance between the upper surface and the virtual cylinder is smaller near the trailing edge.

2. The industrial device according to claim 1, wherein the upper surface and the lower surface have an asymmetric curvature.

3. The industrial device according to claim 1, wherein a camber of the upper surface of the tool is more pronounced than a camber of the lower surface, which is relatively flat.

4. The industrial device according to claim 1, wherein the leading edge and the trailing edge are round, wherein the radius of the leading edge is larger than the radius of the trailing edge, or the radius of the leading edge is 3-10 times larger than the radius of the trailing edge.

5. The industrial device according to claim 1, wherein the leading edge is round, and the trailing edge is sharp.

6. The industrial device according to claim 1, wherein the airfoil profile of the tool has a mean camber line located above a chord line.

7. The industrial device according to claim 1, wherein the at least one tool is a wing, wherein the wing has different airfoil profiles in the direction of the rotation axis of the rotary shaft to provide different foodstuff processing zones in the longitudinal direction of the shaft.

8. The industrial device according to claim 1, wherein the at least one tool helically surrounds the rotation axis.

9. The industrial device according to claim 1, wherein the maximum thickness of the airfoil profile is located closer to the leading edge than the trailing edge.

10. The industrial device according to claim 1, wherein the airfoil profile of the tool has a chord length being at least ⅓ of the minimal distance between the rotation axis and the tool.

11. The industrial device according to claim 1, wherein in the container a main foodstuff transport direction extends parallel to the rotary shaft, wherein the container comprises an inlet located closer to a first end of the rotary shaft than to a second end of the rotary shaft, through which inlet the foodstuffs to be processed in the container can be introduced into the container, as well as an outlet located closer to the second end of the rotary shaft than to the first end of the rotary shaft, through which outlet the processed foodstuffs can be discharged.

12. The industrial device according to claim 1, wherein the container comprises an inlet for introducing the foodstuffs to be processed into the container, as well as an outlet for discharging the processed foodstuffs, wherein the inlet and the outlet at least partly overlap each other.

13. The industrial device of claim 1, wherein the device comprises a container having at least another counter-rotating rotary shaft.

14. Industrial device according to claim 13, wherein the tools of the rotary shafts rotate freely in overlapping virtual rotating circles.

15. The industrial device according to claim 1, wherein the device is configured for continuously processing foodstuffs.

16. The industrial device according to claim 1, wherein the container contains irregularities in the inner container wall.

17. The industrial device of claim 13, wherein the at least two counter-rotating rotary shafts are identical.

* * * * *